US006294034B1

(12) United States Patent
O'Mara et al.

(10) Patent No.: US 6,294,034 B1
(45) Date of Patent: Sep. 25, 2001

(54) TEXTURE AND TAPE DISPENSER

(75) Inventors: John E. O'Mara; Robert E. O'Mara, both of Wichita, KS (US)

(73) Assignee: Renegade Tool, LLC, Parsons, KS (US)

( * ) Notice: Subject to any disclaimer, the term of this patent is extended or adjusted under 35 U.S.C. 154(b) by 0 days.

(21) Appl. No.: 09/498,101

(22) Filed: Feb. 4, 2000

Related U.S. Application Data

(60) Provisional application No. 60/118,573, filed on Feb. 5, 1999.

(51) Int. Cl.[7] ..... B44C 7/04

(52) U.S. Cl. ..... 156/71; 156/575; 156/577; 156/578; 156/579

(58) Field of Search ..... 156/71, 574, 575, 156/577, 578, 579

(56) References Cited

U.S. PATENT DOCUMENTS

| | | | | |
|---|---|---|---|---|
| 2,741,220 | | 4/1956 | Belisle | 118/405 |
| 3,260,638 | | 7/1966 | Hoveland | 156/575 |
| 3,576,091 | | 4/1971 | Shull, Jr. et al. | 52/309 |
| 3,707,427 | | 12/1972 | Erickson | 156/575 |
| 4,208,239 | | 6/1980 | Lass | 156/575 |
| 4,642,158 | | 2/1987 | Steinel et al. | 156/497 |
| 4,652,331 | | 3/1987 | Plasencia | 156/526 |
| 4,689,107 | | 8/1987 | Entwistle | 156/465 |
| 4,775,442 | | 10/1988 | Januska | 156/575 |
| 4,828,647 | * | 5/1989 | Eccleston | 156/526 |
| 5,013,389 | | 5/1991 | Retti | 156/526 |
| 5,114,527 | * | 5/1992 | Stern et al. | 156/575 |
| 5,230,608 | | 7/1993 | Januska | 417/44 |
| 5,242,495 | | 9/1993 | Hammond et al. | 118/43 |
| 5,814,184 | * | 9/1998 | Denkins | 156/577 |

* cited by examiner

*Primary Examiner*—James Sells
(74) *Attorney, Agent, or Firm*—Bracewell & Patterson, L.L.P.

(57) ABSTRACT

A drywall texture and tape dispensing device has a hand held dispenser with a mud chamber. The dispenser tapers toward an exit end with two, parallel slots for dispensing a thin layer of dry wall mud onto a dry wall surface along with the drywall tape. A semi-rigid, flexible strap is affixed to the dispenser and extends past its back end. The strap has an arm band that secures to the arm of the user. The device also has a pair of tape guide loops that are loosely joined to the strap to allow twisting and flexibility. A blade is affixed to the dispenser for smoothing mud on a surface. A mud line is provided to receive mud for delivery to the mud chamber. A tape dispenser is supported by the user, typically on the user's belt. The tape dispenser is positioned to sequentially feed tape through the guide loops and out through tape dispensing slot on the exit end of the hand held dispenser for application to a surface. The user applies the mud and tape simultaneously to a wall surface. The blade is used to smooth the mud and tape combination onto the surface as desired.

26 Claims, 2 Drawing Sheets

TEXTURE AND TAPE DISPENSER

This application claims the benefit of U.S. Provisional Patent Application Ser. No. 60/118,573 filed Feb. 5, 1999.

BACKGROUND OF THE INVENTION

1. Technical Field:

This invention relates in general to preparing dry wall surfaces, and in particular to an improved texture and tape dispenser for preparing dry wall surfaces.

2. Description of the Prior Art:

Efficiently providing drywall tape with a coating of drywall mud of desired thickness for application to drywall panels is one of the problems associated with "taping and floating" drywall joints, seams, and cracks in walls and ceilings. Conventional designs for achieving this end typically utilize a tray or container of mud which is carried by or positioned near the user. A roll of drywall tape is also carried by the user. The tape is manually dispensed and extended through the drywall mud in the container for application of the drywall mud to the tape prior to application of the tape to the drywall panels. This system is cumbersome and difficult to master, since it requires considerable manual dexterity to remove a strip of tape of desired length from the roll and extend the tape through the drywall mud container to uniformly apply drywall mud to the tape in a desired thickness for application to the drywall panels.

Prior art drywall application systems have a number of significant problems. One difficulty with these techniques is trying to uniformly apply the drywall mud to the tape such that the tape will be securely applied to the drywall crack, space, or seam to provide a smooth and efficient floating job. Another inefficiency associated with conventional equipment is frequent requirement of refilling the relatively small mud container, which requires additional time and is labor-intensive, thus adding to the cost of the job. Yet another problem is the extreme caution the user must take in order to avoid spilling the slurry or mud when the user is bending, squatting or stooping to perform various necessary functions on the job. Finally, prior art drywall mud containers must be cleaned before breaks, lunch or at the end of the day, to avoid contamination of the mud with dried mud particles. Thus, an improved method and apparatus for applying drywall tape and texture is needed.

SUMMARY OF THE INVENTION

A drywall texture and tape dispensing device has a hand held dispenser with a mud chamber. The dispenser tapers toward an exit end with two, parallel slots for dispensing a thin layer of dry wall mud onto a dry wall surface along with the drywall tape. A semi-rigid, flexible strap is affixed to the dispenser and extends past its back end. The strap has an arm band that secures to the arm of the user. The flexible strap has a thumb access hole so that the user can push the tape forward with his thumb as needed.

The device also has a pair of tape guide loops that are loosely joined to the strap to allow twisting and flexibility. A blade is affixed to the dispenser for smoothing mud on a surface. A mud line is provided to receive mud for delivery to the mud chamber. A tape dispenser is supported by the user, typically on the user's belt. The tape dispenser is positioned to sequentially feed tape through the guide loops and out through tape dispensing slot on the exit end of the hand held dispenser for application to a surface. The user applies the mud and tape simultaneously to a wall surface. The blade is used to smooth the mud and tape combination onto the surface as desired.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE INVENTION

Figure 1:
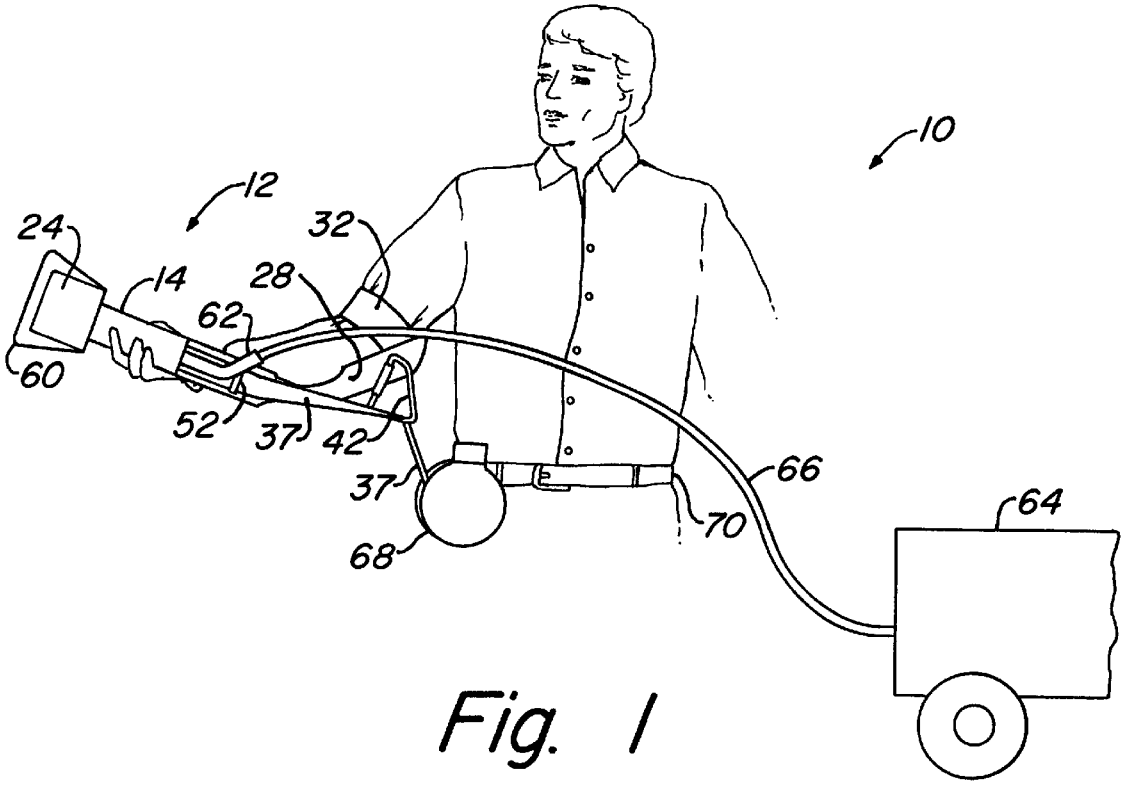
FIG. 1 is a schematic diagram illustrating use of a texture and tape dispenser constructed in accordance with the invention.
Figure 2:
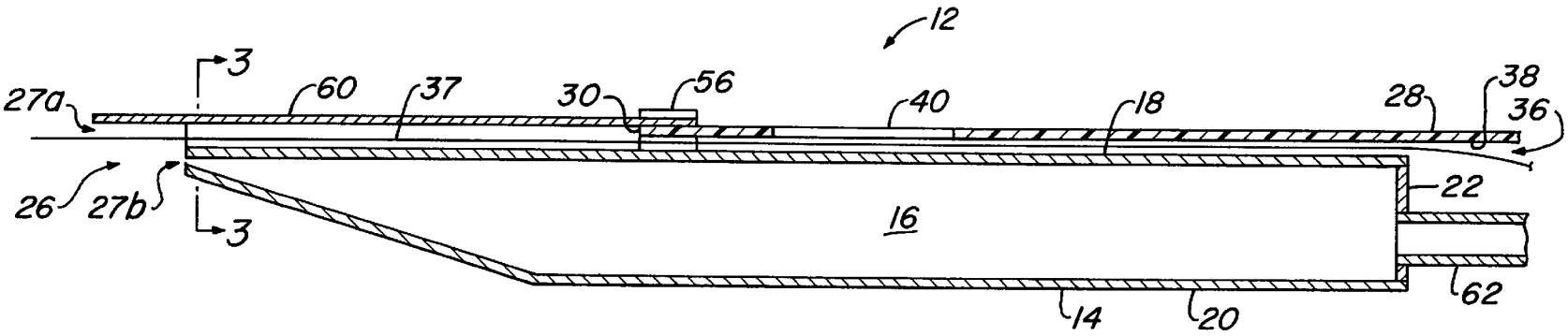
FIG. 2 is an enlarged sectional side view of a hand held dispenser of the texture and tape dispenser of FIG. 1.

Referring now to FIGS. 1–4, a texture and tape dispenser is designated generally 10. As best seen in FIG. 2, texture and tape dispenser 10 includes a hand held dispenser 12 that is made up of a housing 14 that defines an optional dry wall texture compound or mud chamber 16. In the preferred embodiment, the volume of mud chamber 16 is minimized in order to reduce the weight of dispenser 10 during operation. As such, mud chamber 16 ideally performs as a small manifold rather than a reservoir. Housing 14 has a flat upper surface 18, a lower surface 20 and a back end 22. When viewed from the side (FIG. 2), housing 14 has a generally triangular cross-section to better facilitate handling and gripping of the device during operation.

Figure 3:
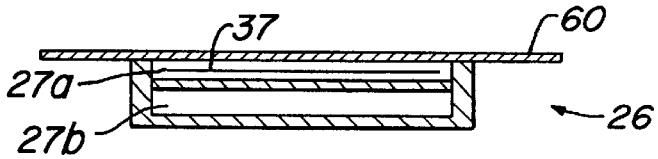
FIG. 3 is a sectional end view of the hand held dispenser of FIG. 2 taken along line 3—3 of FIG. 2.
Figure 4:
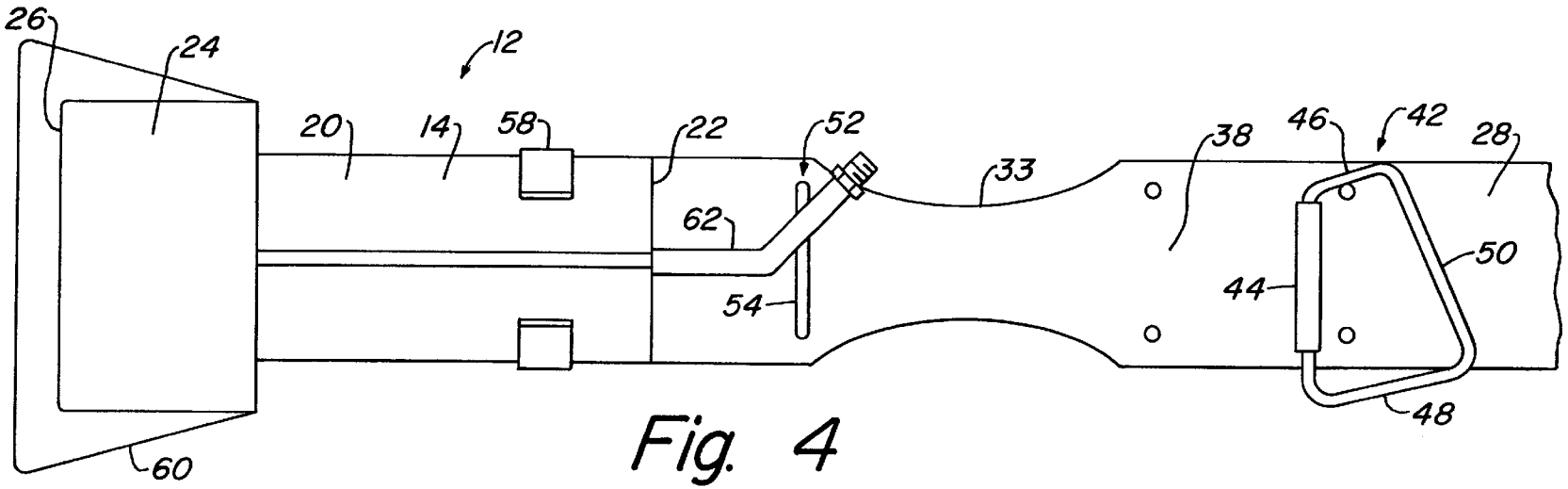
FIG. 4 is a bottom view of the hand held dispenser and flexible strap of the texture and tape dispenser of FIG. 1.

As shown in FIGS. 1 and 4, a mud dispenser 24 is positioned on a forward edge of housing 14. Mud dispenser 24 tapers toward an exit end 26 for dispensing a thin layer of dry wall mud onto a dry wall surface. Referring now to FIGS. 2 and 3, exit end 26 of mud dispenser 24 has two parallel, product dispensing slots: a tape dispensing slot 27*a* and a mud dispensing slot 27*b*. In the embodiment shown, slots 27*a*, 27*b* are generally rectangular, with tape dispensing slot 27*a* located above and slightly narrower than mud dispensing slot 27*b* (FIG. 3).

The front end 30 of a semi-rigid yet flexible strap 28 (FIGS. 1 and 2) is affixed to upper surface 18 of housing 14. Flexible strap 28 is preferably plastic and extends past the back end 22 of housing 14. An arm band 32 (FIG. 1) secures flexible strap 28 to the upper arm of the user. A narrow flexible section 33 (FIG. 4) is provided on flexible strap 28 to facilitate flexing and twisting of flexible strap 28. A tape channel 36 (right side of FIG. 2) is defined between an underside 38 of flexible strap 28 and upper surface 18 of housing 14. Tape channel 36 receives dry wall tape 37. Flexible strap 28 also has a thumb access 40 (FIG. 2) near front end 30 of flexible strap 28 so that the user can push tape 37 forward with his thumb as needed.

Referring now to FIG. 4, a first tape guide loop 42 is affixed to flexible strap 28 with a first securing loop 44. First tape guide loop 42 has a short edge 46 and a long edge 48 such that a tape receiving edge 50 is not parallel to securing loop 44. In addition, the securing loop 44 is somewhat loosely joined to strap 28 so that guide loop 42 may be twisted relative to strap 28. A second tape guide loop 52 is located forward of first tape guide loop 42 on the same surface of strap 28. Second tape guide loop 52 is affixed to flexible strap 28 with a second securing loop 54. As shown in FIG. 1, tape guide loops 42, 52 are suspended from flexible strap 28 in operation.

A strap securing plate 56 (FIG. 2) is mounted to an upper side of housing 14. Strap securing plate 56 secures front end 30 of flexible strap 28 to housing 14. A pair of rivet clamps 58 (FIG. 4) are provided near the back end 22 of housing 14 and extend over upper surface 18 of housing 14 for securing and providing additional support for flexible strap 28 on housing 14.

As shown in FIG. 2, a blade 60 having a straight edge is affixed to strap securing plate 56. Blade 60 extends forward of housing 14 and is used to smooth mud on a substantially flat surface. Alternatively, blade 60 may be adapted to smooth mud in corners as well. In the preferred embodiment, blade 60 is offset from or extends approximately ⅛ inch beyond the front end (to the left) of slots 27*a*, 27*b* on exit end 26. Blade 60 is substantially parallel to the orientation of slots 27*a*, 27*b* (FIG. 3). A mud line 62 (FIGS. 2 and 4) is provided on back end 22 of housing 14 to receive mud for delivery to the mud chamber 16. A mud pump 64 (FIG. 1) has a mud tube 66 communicating with mud line 62 to deliver a continuous supply of mud from mud pump 64 to the manifold or mud chamber 16. A tape dispenser 68 is adapted to be supported by the user (e.g., hang from the user's belt 70). Tape dispenser 63 is positioned to sequentially feed tape 37 through first tape guide loop 42, second tape guide loop 52, tape channel 36, and out through tape dispensing slot 27*a* on exit end 26 of hand held dispenser 12 for application to a surface.

In operation (FIG. 1), a user preferably affixes tape dispenser 68 to his belt 70. By affixing tape dispenser 68 to belt 70, the weight of tape 37 and dispenser 68 are not carried by the user's arm, but instead are carried by the user's belt 70, thereby reducing arm fatigue associated with using texture and tape dispenser 10. The user straps arm band 32 around his arm, thereby securing flexible strap 28 to his arm. Tape 37 is then fed from tape dispenser 68 to the first tape guide loop 42, which is affixed to flexible strap 28. Tape 37 proceeds through second tape guide loop 52 and into the tape channel 36 (see FIG. 2). Tape 37 continues toward exit end 26 of the hand held dispenser 12, and out through tape dispenser slot 27*a*. Initially, the user propagates tape 37 in this direction by engaging tape 37 with his or her thumb through thumb access hole 40 in strap 28. By pushing tape 37 forward (toward exit end 26), the user dispenses tape 37 through tape dispenser slot 27*a*.

Again referring to FIG. 1, mud tube 66 is affixed to a terminal end of mud line 62, which extends outward from hand held dispenser 12 and communicates with housing 14. When a user desires to apply mud and tape 37 to a wall surface, mud pump 64 is activated to send mud through mud tube 66, mud line 62, and the manifold or mud chamber 16 of housing 14. The mud then exits from mud chamber 16 (FIG. 2) through the mud dispensing slot 27*b* in exit end 26 of the hand held dispenser 12. Tape 37 is fed simultaneously from exit end 26 through tape dispensing slot 27*a* (FIG. 3). To initially assist in delivering tape 37 from exit end 26, a user may engage tape 37 with his thumb through thumb access hole 40 in flexible strap 28 (FIG. 2). However, after the process has been initiated, the tape 37 is automatically drawn from tape dispenser 68 and dispensed at exit end 26. This allows the user to simultaneously apply the mud and tape to a wall surface. Blade 60 is utilized to smooth the mud and tape combination onto the surface to create a desired finish in a single action.

The invention has several advantages. The integrated drywall texture and tape dispenser better facilitates the efficient application of tape, mud, and wiping thereof in a single step. The unique design of the apparatus also improves handling and gripping of the device during operation. The mud dispenser is tapered for dispensing a thin layer of dry wall mud and tape onto a dry wall surface through two parallel slots. The slots are only about ⅛ inch away from the wipedown blade so that mud may be applied without excessive amounts of mud building up under the blade, before it can reach the wall and spread out. The close proximity of the slots to the wall surface prevents the mud from running out from under the blade and falling to the floor. It also reduces the blade's angle of orientation relative to the wall so the user may view the mud/wall interface. Consequently, the user has better control of the placement of the mud while leaving less mud on the wall. The semi-rigid, flexible strap comfortably secures to the arm of the user. The strap also flexes and twists with the movement of the user. The strap also has a thumb access hole to allow the user to feed the tape as needed. In addition, the apparatus has a pair of tape guide loops for feeding the tape from a belt dispenser supported by the user, thereby reducing arm fatigue.

While the invention has been shown in several embodiments, it should be apparent that it is not limited to those embodiments but is susceptible to various changes without departing from the scope of the invention.

We claim:

1. A method for applying tape and texture to a surface, comprising the steps of:

(a) providing a tool with a tape guide, a tape outlet, a mud outlet, and a blade, wherein the tape and mud outlets are located adjacent to the blade;

(b) connecting the tool to a source of mud;

(c) feeding tape from a tape dispenser supported on a body of a user, through the tape guide, and to the tape outlet of the tool;

(d) positioning the tool with a hand of the user such that the blade is located adjacent to a desired discharge point on a surface; and (e) flowing mud to the tool and through the mud outlet onto the tape while simultaneously dispensing the tape through the tape outlet and simultaneously wiping excess mud from the surface with the blade in a single action.

2. The method of claim 1 wherein step (c) comprises mounting the tape dispenser on a belt of the user.

3. The method of claim 1, further comprising the step of feeding the tape through a tape channel in the tool prior to the tape reaching the tape outlet and after the tape passes through the tape guide.

4. The method of claim 1, further comprising the step of manipulating the tape with a thumb of the user through a thumb access hole on the tool.

5. A method for applying tape and texture, comprising the steps of:

(a) providing a housing with a tape outlet and a mud outlet located adjacent to a blade, and a flexible strap with a tape guide;

(b) connecting the housing to a source of mud;

(c) attaching a portion of the flexible strap to an arm of the user;

(d) feeding tape from a tape dispenser supported by a user through the tape guide on the flexible strap to the tape outlet in the housing;

(e) positioning the housing with a hand of a user such that the blade is located adjacent to a desired discharge point on a surface; and (f) flowing mud to the housing and through the mud outlet onto the tape while dispensing the tape through the tape outlet and wiping excess mud from the surface with the blade in a single action.

6. The method of claim 5, further comprising the step of mounting the tape dispenser on a belt of the user before step (d).

7. The method of claim 5, further comprising the step of feeding the tape through a tape channel defined between the flexible strap and the housing, prior to the tape reaching the tape outlet and after the tape passes through the tape guide.

8. The method of claim 5, further comprising the step of manipulating the tape with a thumb of the user through a thumb access hole in the flexible strap.

9. An integrated system for applying tape and texture to a surface, comprising in combination:

a housing having a blade mounted thereto, a tape outlet and a mud outlet located adjacent to the blade, and wherein the housing is adapted to be held in a hand of a user;

a flexible strap having a first portion mounted to the housing and a second portion that is adapted to be mounted to an arm of the user;

a tape dispenser adapted to be supported by the user for dispensing tape;

a tape guide mounted to the flexible strap and adapted to guide tape from the tape dispenser to the housing;

a mud pump for delivering a continuous supply of mud to the housing; and wherein the housing is adapted to simultaneously dispense mud and the tape through the mud and tape outlets of the housing, respectively, such that the user may simultaneously apply the mud and tape to a surface and wipe excess mud therefrom with the blade in a single, integrated action.

10. The integrated system of claim 9 wherein the housing has a mud chamber with a mud intake for interconnection with the conduit of the mud pump, wherein the mud chamber dispenses mud through the mud outlet.

11. The integrated system of claim 9 wherein the tape and mud outlets comprise a pair of slots, one on top of the other, respectively, the slots being oriented substantially parallel to an edge of the blade of the housing.

12. The integrated system of claim 9 wherein the blade is offset from the tape and mud outlets by approximately ⅛ inch.

13. The integrated system of claim 9 wherein the first portion of the strap is mounted to an upper surface of the housing, and the second portion of the strap is an arm band that is adapted to be secured to an upper arm of the user.

14. The integrated system of claim 9 wherein the tape dispenser is adapted to be supported on a belt of the user.

15. The integrated system of claim 9 wherein the tape guide comprises a pair of tape guide loops suspended from the flexible strap.

16. The integrated system of claim 9 wherein a tape channel is defined between the flexible strap and the housing, the tape channel being adapted to direct tape to the tape outlet.

17. The integrated system of claim 9 wherein the flexible strap has a thumb access hole for providing the user access to the tape for manipulation thereof.

18. An integrated tape and texture applicator, comprising:

a tool having a mud inlet that is adapted to be connected to a mud supply, a mud outlet, a tape outlet, a tape channel in communication with the tape outlet, and a blade with a straight edge, wherein the mud and tape outlets are located adjacent to the straight edge, and wherein the tool is adapted to be held in a hand of a user;

a tape guide mounted to the tool and adapted to guide tape from a tape supply to the tape channel; and wherein the tool is adapted to simultaneously dispense mud and the tape through the mud and tape outlets of the tool, respectively, such that the user may simultaneously apply the mud and tape to a surface and wipe excess mud therefrom with the blade in a single, integrated action.

19. The integrated tape and texture applicator of claim 18 wherein the tape and mud outlets comprise a pair of generally rectangular slots, one on top of the other, respectively, the slots being oriented substantially parallel to the straight edge of the blade.

20. The integrated tape and texture applicator of claim 18 wherein the straight edge of the blade is offset from the tape and mud outlets by approximately ⅛ inch.

21. The integrated tape and texture applicator of claim 18 wherein the tape guide comprises a pair of tape guide loops.

22. An integrated tape and texture applicator, comprising:

a housing containing a mud chamber with a mud inlet that is adapted to be connected to a mud supply, and a mud outlet, the housing having a blade mounted thereto and a tape outlet, wherein the tape and mud outlets are located adjacent to the blade, and wherein the housing is adapted to be held in a hand of a user;

a flexible strap mounted to the housing and defining a tape channel between the flexible strap and the housing, the tape channel being in communication with the tape outlet in the housing, and the flexible strap having an arm band opposite the housing that is adapted to be attached to an arm of the user;

a tape guide suspended from the flexible strap and adapted to guide tape from a tape supply to the tape channel; and wherein the housing is adapted to simultaneously dispense mud and the tape through the mud and tape outlets of the housing, respectively, such that the user may simultaneously apply the mud and tape to a surface and wipe excess mud therefrom with the blade in a single, integrated action.

23. The integrated tape and texture applicator of claim 22 wherein the tape and mud outlets comprise a pair of slots, one on top of the other, respectively, the slots being oriented substantially parallel to a straight edge of the blade of the housing.

24. The integrated tape and texture applicator of claim 22 wherein the blade is offset from the tape and mud outlets by approximately ⅛ inch.

25. The integrated tape and texture applicator of claim 22 wherein the tape guide comprises a pair of tape guide loops suspended from the flexible strap.

26. The integrated tape and texture applicator of claim 22 wherein the flexible strap has a thumb access hole for providing the user manipulative access to the tape while the tape is in the tape channel.

* * * * *